US005173387A

United States Patent [19]

Niki et al.

[11] Patent Number: 5,173,387

[45] Date of Patent: Dec. 22, 1992

[54] ELECTROPHOTOGRAPHIC DRY DEVELOPER

[75] Inventors: Masao Niki, Wakayama; Koji Akiyama, Osaka; Yutaka Kanamaru, Wakayama, all of Japan

[73] Assignee: KAO Corporation, Tokyo, Japan

[21] Appl. No.: 834,983

[22] Filed: Feb. 14, 1992

Related U.S. Application Data

[63] Continuation of Ser. No. 429,554, Oct. 31, 1989, abandoned.

[30] Foreign Application Priority Data

Nov. 2, 1988 [JP] Japan ..... 63-278105

[51] Int. Cl.[5] ..... G03G 9/00

[52] U.S. Cl. ..... 430/109; 430/110; 430/904

[58] Field of Search ..... 430/109, 110, 904

[56] References Cited

U.S. PATENT DOCUMENTS

| | | | |
|---|---|---|---|
| 2,221,776 | 11/1194 | Carlson . | |
| 2,297,691 | 10/1942 | Carlson . | |
| 2,357,809 | 9/1944 | Carlson . | |
| 3,941,898 | 3/1976 | Sadamatsu et al. | 430/110 X |
| 4,518,673 | 5/1985 | Noguchi et al. | 430/108 |
| 4,560,635 | 12/1984 | Hoffend et al. . | |
| 4,714,717 | 12/1987 | Londrigan et al. | 521/131 |
| 4,762,763 | 8/1988 | Nomura et al. | 430/110 |
| 4,857,433 | 8/1989 | Shin et al. | 430/120 |
| 4,943,506 | 7/1990 | Demizu et al. | 430/110 |

FOREIGN PATENT DOCUMENTS

| | | |
|---|---|---|
| 0122650 | 10/1984 | European Pat. Off. . |
| 59-165068 | 9/1984 | Japan . |
| 60-112050 | 6/1985 | Japan . |
| 60-123851 | 7/1985 | Japan . |
| 61-120156 | 6/1986 | Japan . |

*Primary Examiner*—Marion E. McCamish
*Assistant Examiner*—Stephen Crossan
*Attorney, Agent, or Firm*—Birch, Stewart, Kolasch & Birch

[57] ABSTRACT

An electrophotographic dry developer which comprises a carrier and toner particles comprising a binder resin comprising (A) a polyester resin and (B) a styrene-acrylic resin obtained by co-polymerizing a monomer having an amino group, at a weight ratio of (A) to (B) ranging from 55:45 to 95:5, both resin (A) and resin (B) and a dyestuff or pigment of chromatic color. It is positively charageable and serves for color electrophotography.

4 Claims, No Drawings

ELECTROPHOTOGRAPHIC DRY DEVELOPER

This application is a continuation of application Ser. No. 07,429,554 filed on Oct. 31, 1989, now abandoned.

The invention relates to a developer of electrostatic latent images in the field of the electrophotography, electrostatic recording and electrostatic printing.

PRIOR ARTS

Prior electrophotographic methods are stated in the specifications of U.S. Pat. No. 2221776, No. 2297691 and No. 2357809. That is, the photoconductive insulating layer is evenly charged and exposed. The electricity charged on the exposed portion shall be dispersed to form an electrostatic latent image. Toner, a colored and charged fine powder, is adhered to the charged latent image. Thus, the image becomes visible.

DEVELOPING PROCESS

The visible image is transferred to transform materials including films (transferring process). The image is then fixed by appropriate fixing methods such as heating, pressing, etc., (fixing process).

The developing method applicable to the electronic photographic method can be broadly divided into the dry development method and wet development method. Further, the former can be separated into a method using a one component developer and a method using a two component developer. The group of two component developers, if classified by the toner transporting system, includes the magnetic brush development method in which powder is applied as the carrier; cascade developing method using a more or less coarse bead carrier; and fur brush development method using less fiber.

As toner applicable to these development methods, fine powder made by dispersing coloring agents like dyestuffs or pigment into natural or synthesized thermoplastic resin was used. For example, various kinds of additives such as coloring agents, charge controllers, wax, etc., are mixed into and dispersed in binding agents of the polystyrene or polyester family. The matter thus produced is crushed into particles of 1~30 u m. Then, the particles are applied as toner.

As toner applicable to a single component developer, toner containing magnetic particles such as magnetite, etc., is used. The toner itself is absorbed and held by the magnetic roll and transferred to the image surface.

Meanwhile, in the case of when a double component developer is applied, toner is usually mixed into carrier particles such as glass beads, iron powders, and by static attraction caused by friction at the time, held in the carrier and transferred to the latent image surface. Concerning the charging property of the toner, the polarity is determined by the charge polarity of the latent image and definite polarity, positive or negative, depending on the amount of charge requested to be given. To have toner hold all required charge, the frictionally charging property of the carrier, its external material and resin, which is a component of toner, can be used but this method is not satisfactory because the toners, charge is too small and it is difficult to reach a desired amount of charge quickly. In these cases, images obtained by development are apt to have fog and not be clear. Therefore, in order to quickly give toner the desired amount of charge, a material called a charge controller is added to control the charging property. For positive electrification, a compound with an electron donor radical-like nigrosine dye is effective and for negative electrification, an electron accepting organic complex including oil-soluble metal-inclusive dyestuffs are widely used. In nigrosine dyes, compatibility with resin is usually not good and, therefore, it is applied after being denatured by oleic acid, stearic acid, etc., in many cases. Besides, as charge controllers of positive electrification, included are fatty acid amines, quaternary ammonium salts, Fettshwarz HBW, Sudan teak schwarz BBC and brilliant spirit. As charge controllers of negative electrification, colloidal silica, fatty acid metallic salt, monoazo coloring metal complex salt, chlorinated paraffin, chlorinated polyester, chromogen shwarz, ETCO, Azo oil black, etc., are used. Many of these electrification controllers stem from the dyestuff and pigment group and generally have complicated structures and strong properties of coloring. In the case of chromatic toner, a colored compound cannot be used and colorless or light colored electrification controllers have been studied for use.

For instance, quaternary ammonium salts, vinyl pyridine, a dehydrated condensate of an ortho positioned amine and decarbonate acid, etc., are applied. Dyes or pigments are, although not completely satisfactory, applied presently because better materials are not available.

These charge controllers are applied usually after being mixed with a thermoplastic resin, dispersed by thermo melting and kneading, pulverized and adjusted to a proper particle size according to the requirements. Although it is inevitable that these dyes, pigments and charge controllers will be used, many problems arise therefrom.

That is, first of all, the molecular structure is so complicated that the property is unstable, the quality is changed by thermo melting and kneading, the performance is apt to change according to the conditions of temperature and humidity, and the quality and property of electronic pictures are easily lowered as a result of increased frequency of copying. The second problem involves the difficulty in dispersing these charge controllers evenly in a thermoplastic resin as it causes a difference in the amount of frictional charges between particles and results in a lowered image quality. The third problem is that because most charge controllers are hydrophilic and not well dispersed in resin, they are exposed to the surface of the toner particles. Therefore, the volume of the charged electricity in the toner is lowered due to charge controllers having absorbed humidity under high humidity conditions. A high quality image cannot be obtained. The fourth problem is that most dyes and pigments generally known as charge controllers are of chromatic color or dark color and cannot be contained in toners which have bright and desired colors. The fifth problem is that if a toner mixed with charge controllers is used for a long time, the charge controllers adhere to the face of the photoactive substances or promote adherence of toner to the photoactive substances, exert harmful effects upon their formation of an electrostatic image, (photoactive substance filming) damage the face of the photoactive substance or cleaning beads, or accelerate the abrasion of the material portion thereof. As stated above, not a few undesirable actions are exerted on the cleaning process of duplicating machines.

In this way, when charge controllers are applied as toners the charge amount produced on this face of toners during the process of creating frictional charge among toner particles or toner carriers may be uneven and, consequentially, such problems as foggy development, scattered toners, and contaminated carriers are apt to occur. Also, these hazards result in a remarkable phenomena when copying is repeated many times, i.e., they become unusable. Additionally, under high humidity, not only is there deterioration of toner image, but also the transcripting efficiency on transfer paper is remarkably lowered and the copy is unusable.

Meanwhile, as color toners, those made by dispersing or dissolving various kinds of dyestuffs or pigments into a binder resin are used. In toners, especially when the purpose is to reproduce full color images by using the three primary colors, the following is very important. That is, not only are all of the basic performances including the above mentioned charging property good, but it also reproduces color which the original images had and, therefore, spectral reflectancies of each color draw almost idealistic curves and very low saturation of black is created. These are very important.

Additionally, not only are spectral reflectancies needed, but also re-projectability of images and colors transferred and fixed on transparency for overhead projector (OHP) is required. In other words, both transparencies and spectacle transmittance must be good.

In case the above charge controllers are applied, a change in hue and lowering of saturation resulting from coloring of charge controllers are produced and, additionally, because of poor dispersity of charge controllers into the binding resin, the transparency is lowered and break through color images cannot be obtained in case they are applied on OHP.

As mentioned above, both in black toner and color toner, charge controllers bring about many undesirable problems, and various devices to avoid these problems have been seen.

For instance, Japanese patent publication No. 60-11205 disclosed an even and sufficient positively-charged developer made as follows:

The purpose is to avoid the offsetting phenomena in the heat-roller fixing method.

Binding resin to be used is a copolymer resin of a copolymer-natured monomer having a specific polyester resin and tertiary amino group and hydrophobic copolymer-natured monomer. Thus, an evenly and sufficiently positively-charged developer toner is made, without using traditional charge controllers, by combining with carrier covered with copolymer resin of vinyl chloride and vinyl acetate.

In this toner, the composing ratio between copolymer-natured monomer with polyester resin and tertiary amino group and copolymer resin of hydrophobic copolymer-natured monomer is 10 to 50 weight percent : 50 to 90 weight percent, and the softening point in the ring and ball system is within the limit of 100° to 180° C.

However, those of a softening degree of 100° C. or more cannot obtain bright images when used as a developer for full color because its transparency is lost. In other words, the purpose of the invention in the above official report is, as stated therein, related with the means for avoiding offset and not related with settlement of tasks concerning the above mentioned color toner.

SUMMARY OF THE INVENTION

The purpose of this invention is related to positively charged dry developers with a stable charging property by which the above mentioned traditional tasks can be settled. Especially, it is to provide a more improved positively charged full color developer.

Another purpose of this invention is to prepare a developer with excellent transparency at the time when it is laid on top of another and also when transferred to and fixed on a transparency.

The additional purpose of this invention is to provide a developer which enables development and transfer faithful to the static latent image, that is, a developer which is without fog or scattered toners at or around the edge and which can obtain a high density image and reproduce excellent half-tones.

Furthermore, this invention is purposed to offer a developer which maintains its initial property even after having been used for a long period of time, which is without toner cohesion and which can be preserved safely.

This invention provides an electrophotographic dry developer which comprises a carrier and toner particles, said toner particles comprising a binder resin comprising (A) a polyester resin and (B) a styrene-acrylic resin obtained by co-polymerizing a styrene compound or/and an acrylic compound and a monomer having an amino group, at a weight ratio of (A) to (B) ranging from 55:45 to 95:5, both resin (A) and resin (B) and a dyestuff or pigment of chromatic color.

It is positively charageable and serves for color electrophotography.

It is preferable that the carrier has been coated with a silicone resin being curable at room temperature and heated at 180 degree C or higher.

An alternative coating is a fluoro resin having 80 mole percent or more of fluorine atoms in the monovalent atoms attached to the carbon atoms.

The inventors, after having made concentrated studies in consideration of the above mentioned present situation of traditional technologies, have developed this invention.

That is, this invention is to prepare positively charged dry developers with the following properties:

In dry developers in which a mixture of carriers and toners are used, binding resin (the main content of toners) consists of polyester resin (A) and styrene acrylic resin (B) produced by copolymerizing with copolymer-natured monomer containing the amino group.

The weight ratio of resin (A) and (B) is within the range of 55:45 to 95:5, and the softening point (ring and ball method) is 110 degrees centigrade or less.

The carrying agents to be mixed with the binding resin are dyes or pigments of chromatic colors.

Additionally, the goal of the invention had been obtained more effectively by the following method:

By covering carriers to be applied with toner, in which the binding resin is applied, with silicon resin which is hardened under normal temperatures, and then treating at high temperatures of 180° C. or more, or alternatively, by covering with fluoro resin, in which the percentage of fluorine atoms is 80 mols percent or more in univalent atoms bonded with the carbonous chain.

Hereinafter, this invention shall be explained in more detail. The main ingredients of binding resin in this invention are a mixture of polyester resin (A) and styrene-acrylic resin (B), which are produced by polymerizing-polymerization-natured monomer containing the amino group.

Polyester resin (A) applied here is synthesized by a polycondensation reaction between polycarboxylic acid and polyhydric alcohol. As the group of polyvalent carboxylic acid, the following carboxylic acid, carboxylic acid anhydride and low class alkylester of carboxylic acid can be applied; e.g., fumaric acid, maleic acid, phthalic acid, isophthalic acid, terephthalic acid, trimellitic acid, pyromellitic acid, 3-isodesyle-1, 2, 5, 6 - hexanetetra carboxylic acid, succinic acid, isootyl-succinic acid and adipic acid.

As the polyhydric alcohol group, the following are applied, e.g., ethylene glycol, diethylene glycol, triethylene alcohol, propylene glycol, butanediol, neopentyl glycol, polyoxyethylene (2.2) -2, 2-bis (4-hydroxyphenyl) propane, polyoxy propylene (2.2) -2, 2-bis (4-hydroxyphenyl) propane, hydrogenated bisphenol A, glycerol and trimethylol propane.

Additionally, if necessary, mono carboxylic acid or mono alcohol can be added as polyester materials.

Meanwhile, as a copolymerizing monomer containing the amino group, which is used in the production of styrene acrylic resin (B), a copolymerized compound of copolymerization-natured monomer containing the amino group, the following can be applied:

Dimethyl aminoethyl methacrylate, diethyl amino ethyl methacrylate, dimethylamino propylacrylamide, P-dimethyl amino styrene, N-vinyl pyridine, N-vinyl pyrolidone. Also, as the styrene acrylic copolymerizing monomer to be used in the production of resin (B), the following can be listed:

E.g., monomers of the styrene family such as styrene, P-methylstyrene, $\alpha$-methylstyrene; esters of acrylic acid and methacrylic acid such as methyl acrylate, ethyl acrylate, butyl acrylate, 2-ethylhexyl acrylate, n-butyl methacrylate and 2-ethylhexyl acrylate.

If necessary, other copolymerizing monomers can be used together with the above.

The weight composition of resin (A) and resin (B), (A):(B) is 55:45~95:5, more preferably 65:35~90:10. If the ratio of resin (B) is 5 or less, the charged electrostatic capacity is not enough or the electrostatic charge becomes negative. If the ratio of resin (B) is 45 or more, the property of dispersing or dissolving dyestuffs and/or pigment of polyester resin will be lost, and in case it is applied in color toners, saturation will be lost and the color will become dull. Furthermore, a defect of OHP's projected image becoming dark will be produced. Therefore, it is undesirable.

The softening point (SP) of resin (A) and (B) under the ring and ball method (JIS K-2207) should be 110° C. or less. SP beyond the said limit will result in too much molar weight and spoiling due to entwinement of the high polymer chain, the rapidly melting property. Thus, the resulting image will lack transparency and be of dull color with low saturation. Especially those of SP over 130 degrees centigrade are not desirable.

As coloring agents for color toners in this invention, widely known dyes or pigments of chromatic colors can be used a listed hereunder:

For Yellow: C.I. Solvent Yellow-21, C.I. Solvent Yellow-114, C.I. Solvent Yellow-77, C.I. Pigment Yellow-12, C.I. Pigment Yellow-14, C.I. Disperse Yellow-164, etc.

For Magenta: C.I. Solvent Red-49, C.I. Solvent Red-128, C.I. Pigment Red-13, C.I. Pigment Red-48.2, C.I. Disperse Red-11, etc.

For Cyan: C.I. Solvent Blue-25, C.I. Solvent Blue-94, C.I. Pigment Blue-15.3, etc.

Furthermore, developer toners in this invention can offer more stabilized images by combination with carriers covered with specific cladding materials.

As carriers to be applied in this invention, widely known carriers can be used, e.g., ferromagnetic materials including iron, ferrite, steel, magnetite, nickel, or glass, etc. Instances of the specific cladding materials are straight silicon resin, fluoro resin, etc.

In the case of where the specific cladding material is a straight silicon resin, a more desirable method is to heat cure at 180° C. or higher after coating the carrier with silicon varnish with a property of curing under ordinary temperatures. Silicon varnish curing under ordinary temperatures is silicon resin of the following chemical structural formula, including KR-114, KR-220, KR-251 and KR-255 (all of which are manufactured by Shin-etsu Chemical Co., Ltd.)

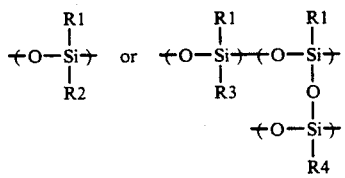

(In this formula, R1~R4 are hydrogen atoms, hydroxyl group, low class alkoxyl group with the number of carbons being 1~4, methyl group or phenylgroup.)

Meanwhile, in case specific cladding material is fluoro resin, it is desirable for the resin to be fluoro resin, whose ratio of fluorine atoms in univalent atom connecting with carbon principal and side chains is 80 mole percent.

Examples of such fluoro resins are poly (tetra fluoro ethylene-vinylidene fluoride), poly (tetra fluoro ethylene-fluoro propylvinyl-ether) copolymer of methacrylic acid 2-fluoro octyl ether and methacrylic acid n-butyl, and poly (tetra fluoro ethylene-hexa fluoro propylene). The above examples are used individually or in mixture.

As stated above, the application of the positively charged dry developer introduced by this invention created the brightest full color images in history. Moreover, images developed on OHP transparency were excellently transparent and luminously transmitted images showed brilliant coloring.

Hereinafter, the invention shall be explained by showing examples of compositions and executions, however, the invention is not limited to these examples. Figures written after names of materials hereinafter shall mean weight ratio of the material in the composition unless otherwise specified.

EXAMPLE OF COMPOSITION I

In a reaction receptacle equipped with a stirrer, refluxing and dehydrating pipe and nitrogen blowing pipe, the last two items of which are to cool and eliminate water produced by the reaction, propylene glycol 149.1, ethylene glycol 52.1 and dimethyl terephthalate 410.2 were placed. At the time of completion of condensation for demethanol at 20° C., trimellitic acid anhydride 55.3 was added thereto for further reaction to produce polyester resin of 104.5° C. softening point and 62.4° C. glass transferring point. (Tg.)

EXAMPLE OF COMPOSITION II

7 In a reaction receptacle similar to Example of Composition I, polyoxypropylene (2.2) - 2.2 -bis (4-hydroxyphenyl) propane 350.0, fumaric acid 116.0 and hydroquinone monomethyl ether 0.2 were placed. While raising the temperature gradually, a dehydration condensation reaction was produced at 210° C. to obtain polyester resin of 98.6° C. softening point and 60.5° C. Tg.

EXAMPLE OF COMPOSITION III

In a reaction receptacle equipped with a stirrer, a refluxing pipe, a dropping funnel and a nitrogen blowing pipe, toluene 60.0 and dodecyl mercaptan 3.0 were placed. When the temperature rose to 90° C. while nitrogen sealing, a mixed solution of styrene 20.0 n-butyl methacrylate 70.0, diethyl amino ethyl methacrylate 10.0, $\alpha$, $\alpha'$-azobis isobutyronitrile 4.0 was instilled and polymerized for 2 hours. After an additional 2 hours of aging, the temperature was risen to 200° C. and the pressure was decreased to 30 mm Hg., to eliminate toluene by topping. The resin obtained had a softening point at 104.5° C. and Tg at 62.3° C.

EXAMPLE OF COMPOSITION IV.

In a reaction receptacle similar to the one used in Example of Composition III, toluene 60.0 and dodecyl mercaptan 3.0 were placed. When the temperature rose to 70° C. while nitrogen sealing, a mixed solution of $\alpha$-methylstyrene 166.0, 2-ethylhexyl acrylate 24.0, dimethyl amino ethyl methacrylate 10.0, $\alpha,\alpha'$-azobis dimethylvalero-nitrile 6.0 was instilled and polymerized for 2 hours. After an additional 2 hours of aging, the temperature was risen to 200° C. and the pressure was decreased to 300 mm Hg., to eliminate toluene by topping. Tho resin obtained had a softening point at 106.2° C. and Tg at 62.8° .

EXAMPLE OF MANUFACTURING I

Iron powder (TSV-300) 1000, made by Nippon Teppun Co., Ltd., as being fluidizated on a fluid bed, was heated up to 60° C., maintained at the same temperature and sprayed with silicon resin (KR-252 of Shin-etsu Silicone Co., Ltd.) 10 (figured on the basis of resin contained therein) solution melted into 5% with toluene. After drying for 20 minutes, it was heat treated at 200° C. for 30 minutes in an electric furnace. Thus, a silicone resin coat carrier was obtained.

EXAMPLE OF MANUFACTURING II

Nippon Teppun-made iron powder (TSV-300) 1000, which was fluidized on a fluid bed and heated up to 80° C., was sprayed with fluoro resin 10 (made by Daicel Chemical Industries, Ltd., Daifuron ND-4) and diluted with water to a 5% solution. Then, after drying for 30 minutes, it was heat treated for 20 minutes in an electric furnace at 300° C. In this manner, a fluoro resin coated carrier was obtained.

| Example of Execution I. | |
|---|---|
| <Composition of Toner> | |
| Polyester resin in Composition Example 1 | 70.0 |
| Styrene-acrylic resin in Composition Example III | 80.0 |
| C.I. Pigment Yellow-14 | 5.0 |
| Viscol 660P (Made by Sanyo Chemical Industries, Ltd., | 2.0 |

-continued

| Example of Execution I. |
|---|
| polypropylene wax) |

After being mixed with a blender, the above components were melted and kneaded with a biaxially extruding type kneader and roughly ground with a cutter mill. Thereafter they were ground with an air-jet mill into 5~20 μm., average particle size being 10 μm, and classified. The fine grains, 100, were blended with hydrophobic silica R972 (made by Nihon Aerosil Co., Ltd.) 0.2, to be made into yellow toner. A developer was produced by mixing yellow toner 50 and silicone resin coat carrier 950 in Manufacturing Example 1 in a V-type blender.

According to the result of the evaluation of the developers, developing performance with a general purpose duplicator, OPC mounted and available in the market, the quantity of charged electricity was 16.5 μc/g at the initial stage, and a bright and intense image without fog was produced. Moreover, after consecutive copying of 10,000 sheets, the quantity of charged electricity was 17.6 μc/g, and good quality images without any differences from the initial one were produced. Also, images copied on OHP sheets had good transparency and images projected with OHP had good yellow color.

| Example of Comparison 1. | |
|---|---|
| <Composition of Toner> | |
| Tuftone NE1110 (Made by Kao Corp., polyester resin SP130 degrees centigrade) | 70.0 |
| Styrene acrylic resin in Composition Example III | 30.0 |
| C.I. Solvent Red-49 | 5.0 |
| Viscol 660P (Made by Sanyo Chemical Industries, Ltd.) | 2.0 |

From the above ingredients, magenta toner was made by the same method as in Execution Example I. Next, developer was produced from said magenta toner 50.0 and silicone resin coat carrier 950 in Manufacturing Example I.

The developer was evaluated in the same method as that in Execution Example I and the results are shown in the following Table 1. Evaluation results of developers in examples hereunder are also collectively shown in Table 1.

| Example of Execution 2. | |
|---|---|
| <Composition of Toner> | |
| Polyester resin in Composition Example I | 70 |
| Styrene-acrylic resin in Composition Example IV | 30 |
| C.I. Solvent Red-49 | 5.0 |
| Viscol 660 (Made by Sanyo Chemical Industries, Ltd.) | 2.0 |

From the above components, magenta toner was produced by the same method as in Execution Example I. Then, developer was manufactured from said magneta toner 50.0 and fluoro resin coat carrier 950 in Manufacturing Example 2.

| Example of Execution 3. |
|---|
| <Composition of Toner> |

-continued

| Example of Execution 3. | |
|---|---|
| Polyester resin in Composition Example II | 80.0 |
| Styrene-acrylic resin in Composition Example III | 20.0 |
| C.I. Pigment Blue-15.3 | 5.0 |
| Viscol 660P (Made by Sanyo Chemical Industries, Ltd.) | 2.0 |

Cyanic toner was produced from the compounds of the above ingredients by the same method as that of Execution Example 1. Next, developer was produced from said cyanic toner 50.0 and fluoro resin coat carrier 950 in Manufacturing Example 2.

| Example of Execution 4. | |
|---|---|
| <Composition of Toner> | |
| Polyester resin in Composition Example I | 75.0 |
| Styrene acrylic resin in Composition Example III | 25.0 |
| C.I. Solvent Yellow-114 | 5.0 |
| Viscol 660P (Made by Sanyo Chemical Industries, Ltd.) | 2.0 |

Yellow toner was produced from compounds of the above ingredients by the same method as stated in Execution Example I. Next, developer was produced from said yellow toner 50.0 and silicone resin coat carrier 950 in Manufacturing Example 1.

| Example of Execution 5. | |
|---|---|
| <Composition of Toner> | |
| Polyester resin in Composition Example II | 80.0 |
| Styrene acrylic resin in Composition Example IV | 20.0 |
| C.I. Pigment Red-13 | 5.0 |
| Viscol 660P (Made by Sanyo Chemical Industries, Ltd.) | 2.0 |

Magneta toner was produced from compounds of the above ingredients by the same method as stated in Execution Example 1. Next, developer was produced from said magneta toner 50.0 and silicone resin coat carrier 950 in Manufacturing Example 1.

| Example of Execution 6. | |
|---|---|
| <Composition of Toner> | |
| Polyester resin in Composition Example II | 75.0 |
| Styrene acrylic resin in Composition Example III | 25.0 |
| C I. Solvent Blue-15.3 | 5.0 |
| Viscol 660P (Made by Sanyo Chemical Industries, Ltd.) | 2.0 |

Cyanic toner was produced from compounds of the above ingredients by the same method as stated in Execution Example 1. Next, developer was produced from said cyanic toner 50.0 and fluoro resin coat carried 950 in Manufacturing Example 2.

| Example of Execution 7. | |
|---|---|
| <Composition of Toner> | |
| Polyester resin in Composition Example II | 60.0 |
| Styrene acrylic resin in Composition Example IV | 40.0 |
| C.I. Pigment Blue-15.3 | 5.0 |
| Viscol 660 (Made by Sanyo Chemical Industries, Ltd.) | 2.0 |

Cyanic toner was produced from compounds of the above ingredients by the same method as stated in Execution Example I. Next, developer was produced from said cyanic toner 50.0 and coat carrier 950 (made by Nippon Teppun TSV-300).

| Example of Comparison 2. | |
|---|---|
| <Composition of Toner> | |
| Polyester resin in Composition Example II | 40.0 |
| Styrene acrylic resin in Composition Example III | 60.0 |
| C.I. Pigment Yellow-14 | 5.0 |
| Viscol 660P (Made by Sanyo Chemical Industries, Ltd.) | 2.0 |

Yellow toner was produced from compounds of the above ingredients by the same method as stated in Execution Example I. Next, developer was produced by said yellow toner 50.0 and fluoro resin coat carrier 950 stated in Manufacturing Example 2.

| Example of Comparison 3. | |
|---|---|
| <Composition of Toner> | |
| Styrene acrylic resin in Composition Example III | 100.0 |
| C.I. Pigment Red-13 | 5.0 |
| Viscol 660P (Made by Sanyo Chemical Industries, Ltd.) | 2.0 |

Magenta toner was produced from compounds of said ingredients by the method stated in Execution Example I. Next, developer was produced from said magneta toner 50.0 and silicon resin coat carrier 950 stated in Manufacturing Example I.

| Example of Comparison 4. | |
|---|---|
| <Composition of Toner> | |
| Polyester resin in Composition Example I | 100.0 |
| Pontron No. 7 (Made by Orient Co. Ltd., Nigrosine dyestuff) | 2.0 |
| C.I. Pigment Blue-15.3 | 5.0 |
| Viscol 660P (Made by Sanyo Chemical Industries, Ltd.) | 2.0 |

Cyanic toner was produced from compounds of the above ingredients by the same method as stated in Enforcement Example I. Next, developer was produced from said cyanic toner 50.0 and fluoro resin coat carrier 950 in Manufacturing Example 2.

The results of the developers obtained in the above Execution Example 1~7 and Comparison Examples 1~4 shall collectively be shown in Table-1.

TABLE 1

| Evaluated Item Developer Nos. | Property at Initial Stage 1) Quantity of Statics Charged | 2) Temperature of Image | 3) Fog | Property after Duplications of 10,000 Sheets 1) Quantity of Statics Charged | 2) Temperature of Image | 3) Fog | 4) Transparency |
|---|---|---|---|---|---|---|---|
| Execution Example 1 | 16.5 | 1.69 | ○ | 17.6 | 1.51 | ○ | ○ |
| Execution Example 2 | 14.7 ○ | 1.66 | ○ | 14.4 | 1.59 | ○ | ○ |
| Execution Example 3 | 13.6 | 1.72 | ○ | 14.7 | 1.60 | ○ | ○ |
| Execution Example 4 | 15.8 | 1.61 | ○ | 15.2 | 1.49 | ○ | ○ |
| Execution Example 5 | 14.4 | 1.64 | ○ | 15.2 | 1.55 | ○ | ○ |
| Execution Example 6 | 14.2 | 1.65 | ○ | 13.8 | 1.63 | ○ | ○ |
| Execution Example 7 | 13.4 | 1.74 | ○ | 11.8 | 1.72 | ○ | ○ |
| Comparison Example 1 | 14.3 | 1.63 | ○ | 14.8 | 1.57 | ○ | × |
| Comparison Example 2 | 18.2 | 1.52 | ○ | 11.6 | 1.26 | ○ | Δ |
| Comparison Example 3 | 22.3 | 1.28 | ○ | 23.4 | 1.07 | ○ | Δ |
| Comparison Example 4 | 11.6 | 1.76 | Δ | 7.2 | 1.83 | × | × |

(Note)
1) Observation by the Blow Off Method (μc/g).
2) Observation by Macbeth densitometer RD-914.
3) Divided into 3 ranks by area rate of foggy toner per unit area of non-image portion. ○ : <0.05%; Δ: 0.05% ~ 0.1%; ×: >0.1%.
4) Projecting with OHP copy of Image Electronic Institute's Chart No. 22. evaluated by viewing with eyes. ○ : Good color development. Δ: No good color development in neutral tint. ×: Entirely no good color development.

What is claimed is:

1. A positively charged electrophotographic dry developer which comprises (a) toner particles, said toner particles comprising (i) a binder resin which comprises a resin component consisting of:

(A) 55 to 95% by weight based on the weight of said resin component of a polyester resin which is the condensation product of a polycarboxylic acid and a polyhydric alcohol; and (B) 45 to 5 by weight based on the weight of said resin component of a styrene-acrylic resin which is a copolymerized product of a styrene monomer, an acrylic monomer, and a monomer containing an amino group, said resin (A) and (B) each having a softening point of 110° C. or less, and (ii) a dyestuff or pigment of chromatic color mixed with said resin component; and (b) a carrier coated with a fluoro resin wherein at least 80 mole percent of the univalent atoms bonded to the carbon chains of said fluoro resin are fluorine atoms.

2. The electrophotographic dry developer according to claim 1, wherein said monomer containing an amino group is selected from the group consisting of dimethyl aminoethyl methacrylate, diethyl amino ethyl methacrylate, dimethylamino propylacrylamide, P-dimethyl amino styrene, N-vinyl pyridine, and N-vinyl pyrolidone.

3. The dry developer according to claim 1, wherein the weight ratio of (A):(B) is in the range of 65:35 to 90:10.

4. The dry developer according to claim 1, wherein said fluoro resin coating on said carrier is selected from the group consisting of poly (tetra fluoro ethylene-vinylidene fluoride), poly (tetra fluoro ethylene-fluoro propylvinyl-ether) copolymer of methacrylic acid 2-fluoro octyl ether and methacrylic acid n-butyl, and poly (tetra fluoro ethylene-hexa fluoro propylene).

* * * * *